US011767166B2

(12) United States Patent
Foster et al.

(10) Patent No.: US 11,767,166 B2
(45) Date of Patent: Sep. 26, 2023

(54) ROLL OUT CART COLLAR

(71) Applicant: Rehrig Pacific Company, Los Angeles, CA (US)

(72) Inventors: Derick Foster, Cumming, GA (US); John Matthew Thomson, Dahlonega, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 17/542,881

(22) Filed: Dec. 9, 2021

(65) Prior Publication Data

US 2022/0194698 A1 Jun. 23, 2022

Related U.S. Application Data

(60) Provisional application No. 63/130,027, filed on Dec. 23, 2020.

(51) Int. Cl.
*B65F 1/16* (2006.01)
*B65F 1/14* (2006.01)

(52) U.S. Cl.
CPC ..... *B65F 1/1646* (2013.01); *B65F 1/1473* (2013.01); *B65F 1/1615* (2013.01); *B65F 2001/1653* (2013.01)

(58) Field of Classification Search
CPC ..... B65F 2001/1653; B65F 2001/1676; B65F 2001/1692; B65F 2210/148; B65F 1/1646
See application file for complete search history.

(56) References Cited

U.S. PATENT DOCUMENTS

| | | | | |
|---|---|---|---|---|
| 2,289,452 | A * | 7/1942 | Punte | B65D 17/401 220/258.5 |
| 3,893,615 | A * | 7/1975 | Johnson | B65F 1/067 220/495.08 |
| 5,385,258 | A * | 1/1995 | Sutherlin | B65F 1/1615 220/908 |
| 5,758,914 | A | 6/1998 | Ioveno | |
| 7,748,558 | B2 | 7/2010 | Rouns | |
| 7,806,287 | B2 | 10/2010 | Rouns | |
| 8,479,944 | B2 | 7/2013 | Moore | |
| 9,963,276 | B1 | 5/2018 | Arthurs et al. | |
| 10,221,011 | B2 | 3/2019 | Stone | |
| D845,577 | S | 4/2019 | Foster | |
| 10,315,842 | B2 * | 6/2019 | Seader | B65F 1/1615 |
| 10,427,842 | B2 | 10/2019 | Siskindovich et al. | |
| 10,906,734 | B2 | 2/2021 | Richter | |
| 10,954,063 | B2 | 3/2021 | Foster | |
| 11,014,716 | B2 | 5/2021 | Tyler et al. | |

(Continued)

FOREIGN PATENT DOCUMENTS

KR 920006183 Y1 * 9/1992 ..... B65F 1/1646

*Primary Examiner* — Mollie Impink
(74) *Attorney, Agent, or Firm* — Carlson, Gaskey & Olds, P.C.

(57) ABSTRACT

A container assembly includes a container body having a side wall extending upward from a base to define a mouth. A lid is pivotably secured to the container body and is pivotable between an open position and a closed position over the mouth of the container body. A collar is secured to an upper edge of the side wall of the container body. The collar reinforces the mouth of the container to prevent deformation thereof, such as by bears, and access between the lid and mouth of the container.

23 Claims, 20 Drawing Sheets

(56) References Cited

U.S. PATENT DOCUMENTS

| | | | | |
|---|---|---|---|---|
| 11,077,603 | B1 | 8/2021 | Baker et al. | |
| 2005/0263970 | A1* | 12/2005 | Foster-Hentz | B65F 1/1426 280/47.26 |
| 2007/0045319 | A1 | 3/2007 | Hogan | |
| 2007/0062949 | A1 | 3/2007 | Bordner | |
| 2007/0175910 | A1* | 8/2007 | Hogarth | B65F 1/1615 220/326 |
| 2017/0320667 | A1 | 11/2017 | Stone | |
| 2021/0253343 | A1* | 8/2021 | Downing | B65F 1/06 |
| 2022/0033179 | A1* | 2/2022 | Young | B65F 1/02 |

* cited by examiner

ROLL OUT CART COLLAR

BACKGROUND

Trash and recycling containers, such as roll-out carts, generally include a container body and a lid pivotably connected to the container body. Some carts include a latch selectively retaining the lid in the closed position.

Bears or other large animals may knock the cart to the ground and then push and pull on the wall of the container body to try to separate the container body from the lid. Such animals may also try to insert a claw between the container body and the lid to separate the lid from the container body.

SUMMARY

A roll-out cart includes a container body having a side wall extending upward to a mouth of the container body. A lid is pivotably connected to a rear portion of the container body. The lid is pivotable between an open position and a closed position covering the mouth of the container body. A latch selectively secures a front portion of the lid to a front portion of the container body. A collar secured to the lip of the container body reinforces the upper edge of the container body. The collar resists impact by bears (for example) that might otherwise deform the mouth of the container body and separate the wall of the container body from the lid. The collar also blocks intrusion between the lid and the wall of the container body, such as by a claw.

DETAILED DESCRIPTION

Figure 1:
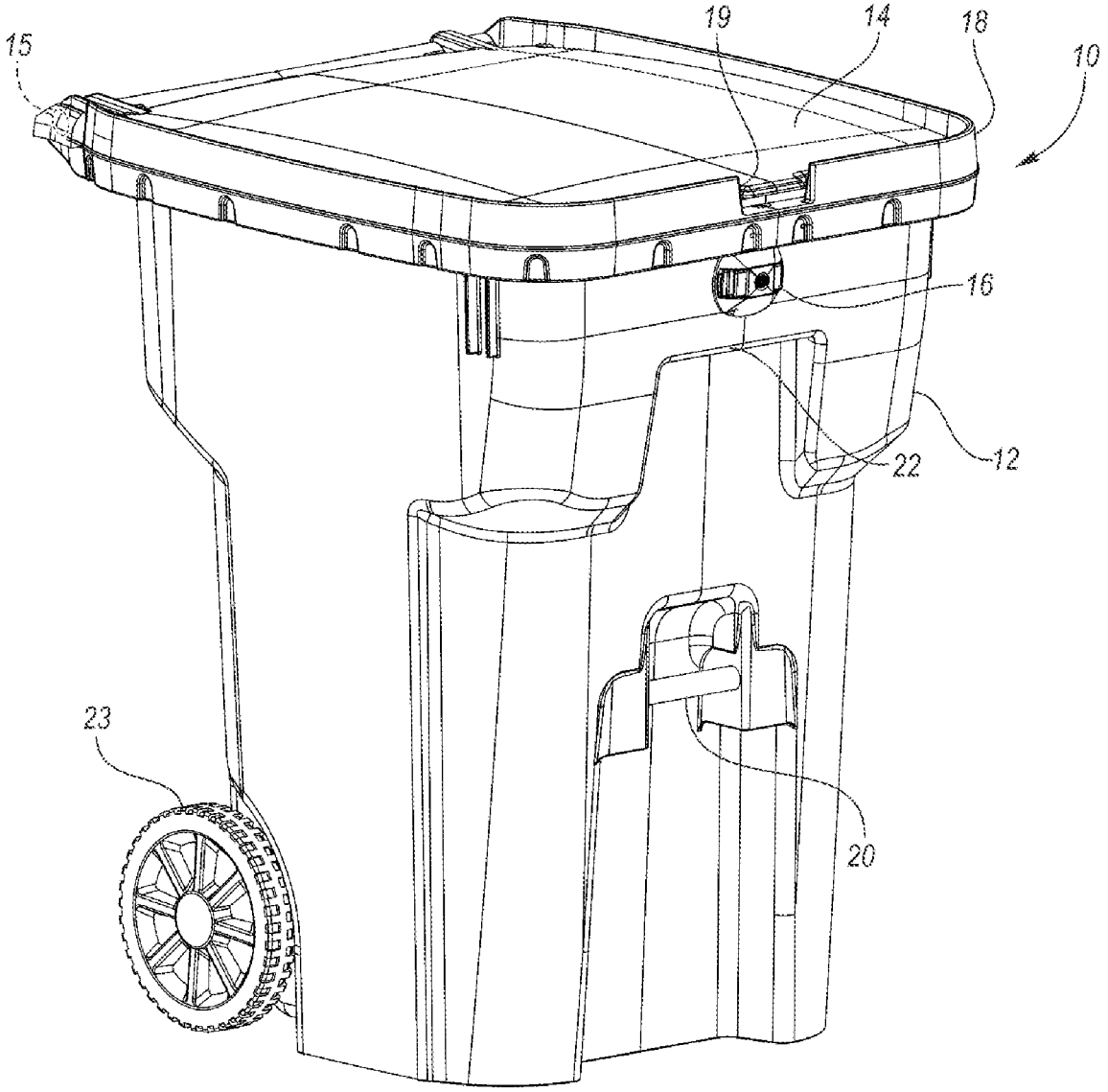
FIG. 1 is a perspective view of a roll-out cart according to one embodiment.

A container assembly according to a first example is a roll-out cart 10 shown in FIG. 1. The roll-out cart 10 is designed to be resistant to bears and other large animals. The roll-out cart 10 includes a container body 12 and lid 14. The lid 14 is pivotably connected at a rearward portion of the roll-out cart 10 by hinge pins 15.

The lid 14 is selectively connected to the container body 12 at a forward portion of the roll-out cart 10 by a latch 16. The latch 16 is secured to the container body 12 and selectively captures a latch member secured to the front portion of the lid 14 in a known manner. The latch 16 may be a gravity-activated latch 16, such that it becomes unlatched automatically when the roll-out cart 10 is inverted, such as when it is being dumped by a lift arm on a collection truck. Latches 16 of this type are known. The container body 12 may be injection molded of a suitable plastic.

A collar 18 is formed separately and secured to an upper lip of the container body 12. When closed, the lid 14 is recessed below an upper edge of the collar 18. In this embodiment, the lid 14 is recessed completely relative to the upper edge of the collar 18. The collar 18 reinforces the mouth of the container body 12 against deformation and inhibits access to the lid 14, which is recessed below the collar 18. The collar 18 also covers the hinge pins 15 that secure the lid 14 to the container body 12.

The front of the container body 12 has a horizontal grab bar 20 which provides a lower grab point. The front of the container body 12 also includes an upper grab point 22, which is a molded undercut or hook, molded integrally with the container body 12. Both the grab bar 20 and the upper grab point 22 are used by automated equipment for lifting and dumping the roll-out cart 10 into a collection vehicle. Wheels 23 are mounted to a lower rear portion of the container body 12 and support the container body 12. The container body 12 includes a side wall extending upward from a base wall to a mouth of the container body 12 to define an internal volume, which in the example shown is approximately 95 gallons.

Figure 2:
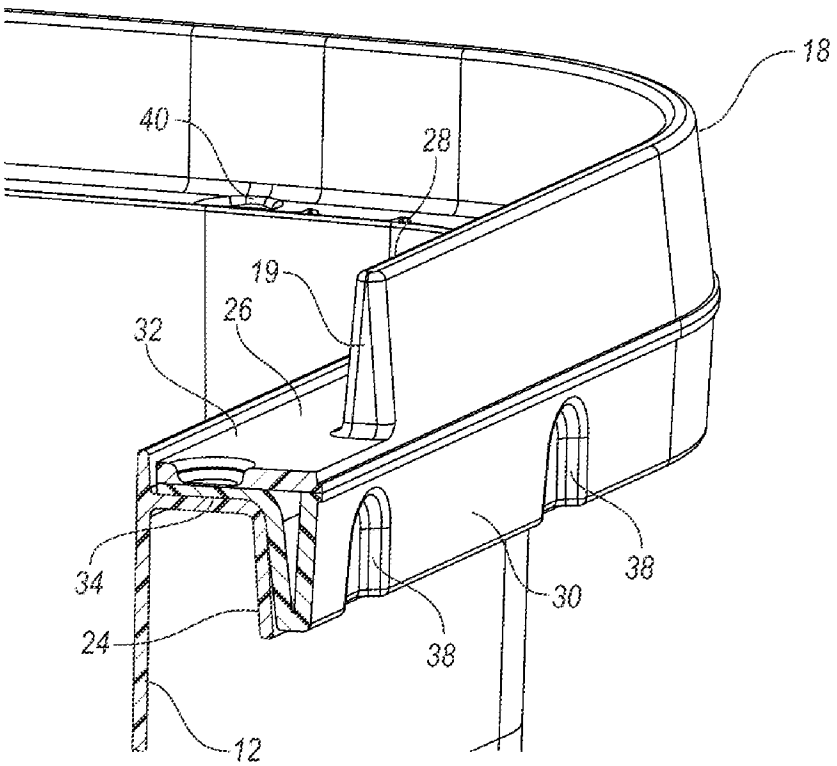
FIG. 2 is a perspective view of the mouth of the roll-out cart of FIG. 1, partially broken away.
Figure 3:
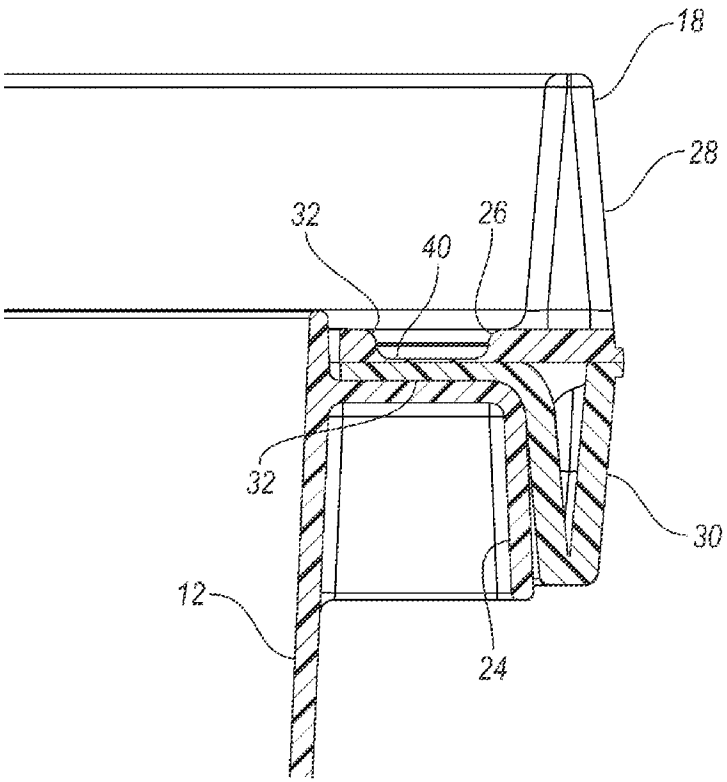
FIG. 3 is a side view of the mouth of FIG. 2.

Referring to FIGS. 2 and 3, a lip 24 projects outward and then downward from the entire periphery of an upper edge of the side wall of the container body 12, spaced downward slightly from an uppermost edge of the side wall of the container body 12. The collar 18 is secured to the lip 24. The collar 18 includes a horizontal portion 26 having an upper peripheral flange 28 projecting upward from a front edge thereof and a lower peripheral flange 30 projecting downward from the front edge thereof.

In this embodiment, the collar 18 is a twin-sheet thermoformed part (themoforming together two sheets of plastic), but it could also be formed in other ways, such as injection molding as a single piece of plastic. The upper portion includes an upper horizontal portion 32 and the upper peripheral flange 28. The lower portion includes a lower horizontal portion 34 and the lower peripheral flange 30. The upper horizontal portion 32 of the upper portion is joined to the lower horizontal portion 34 of the lower portion in the twin-sheet thermoforming process. The upper horizontal portion 32 and the lower horizontal portion 34 together form the horizontal portion 26 of the collar 18.

A plurality of recesses 38 are formed in the lower peripheral flange 30 spaced about the periphery. A plurality of recesses 40 are formed in the upper horizontal portion 32 spaced about the periphery. Rivets and/or screws or other fasteners can be used to secure the collar 18 to the lip 24 of the container body 12 and the recesses 38, 40 makes the fasteners flush with the collar 18. The horizontal portion 26 is secured to the horizontal portion of the lip 24 and the lower peripheral flange 30 is secured to the vertical portion of the lip 24.

The upper peripheral flange 28 and the lower peripheral flange 30 may each comprise a pair of spaced-apart walls. The kiss-off portions form the recesses 38 in the lower peripheral flange 30 and increase its strength. A gap 19 (FIG. 2) is formed in the upper peripheral flange 28 at a front of the roll-out cart 10, to provide finger access to open the lid 14 (FIG. 1).

Figure 4:
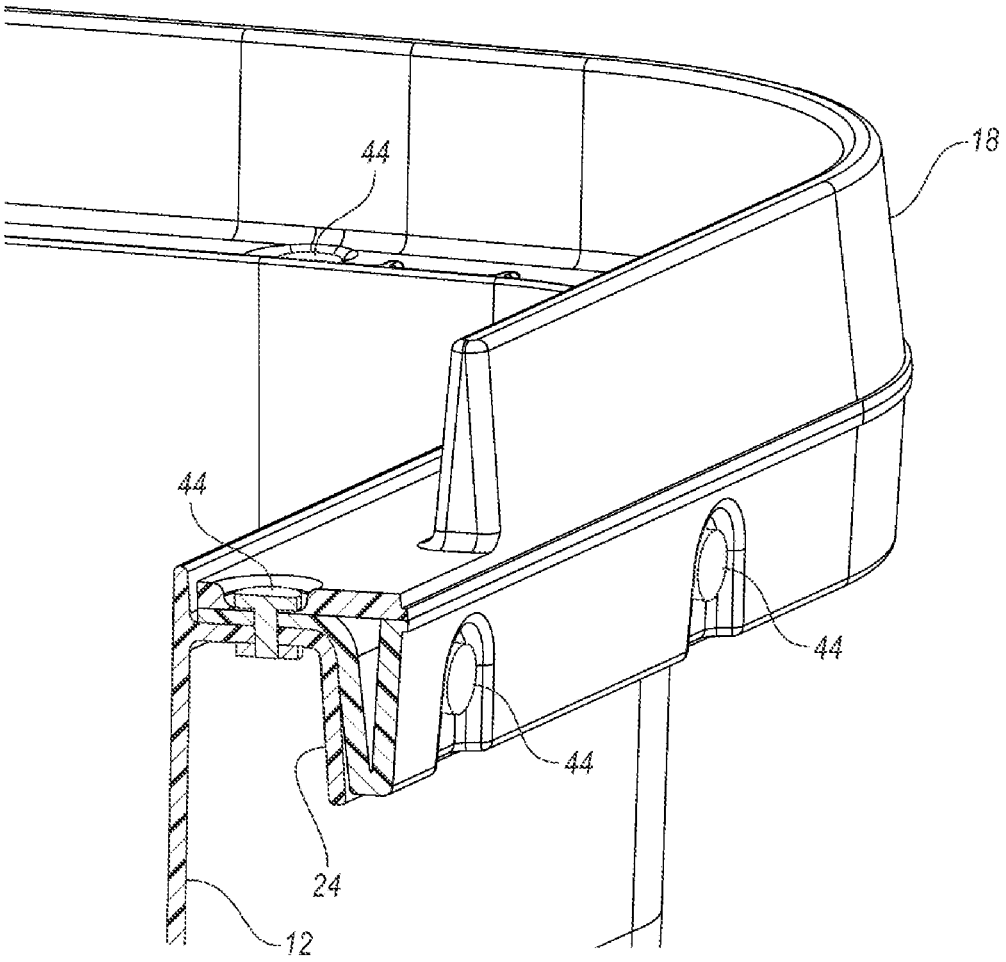
FIG. 4 shows the mouth of FIG. 2 with fasteners securing the collar to the lip of the container body.

FIG. 4 shows the container body 12 and collar 18 of FIG. 2, with fasteners 44 securing the collar 18 to the lip 24 in the recesses 38 and 40. The recesses 38, 40 ensure that the fasteners 44 are flush with the outer surface of the collar 18. The fasteners 44 may be rivets, screws, bolts or the like. Alternatively, adhesive or heat stakes could be used to fasten the collar 18 to the container body 12.

Figure 5:
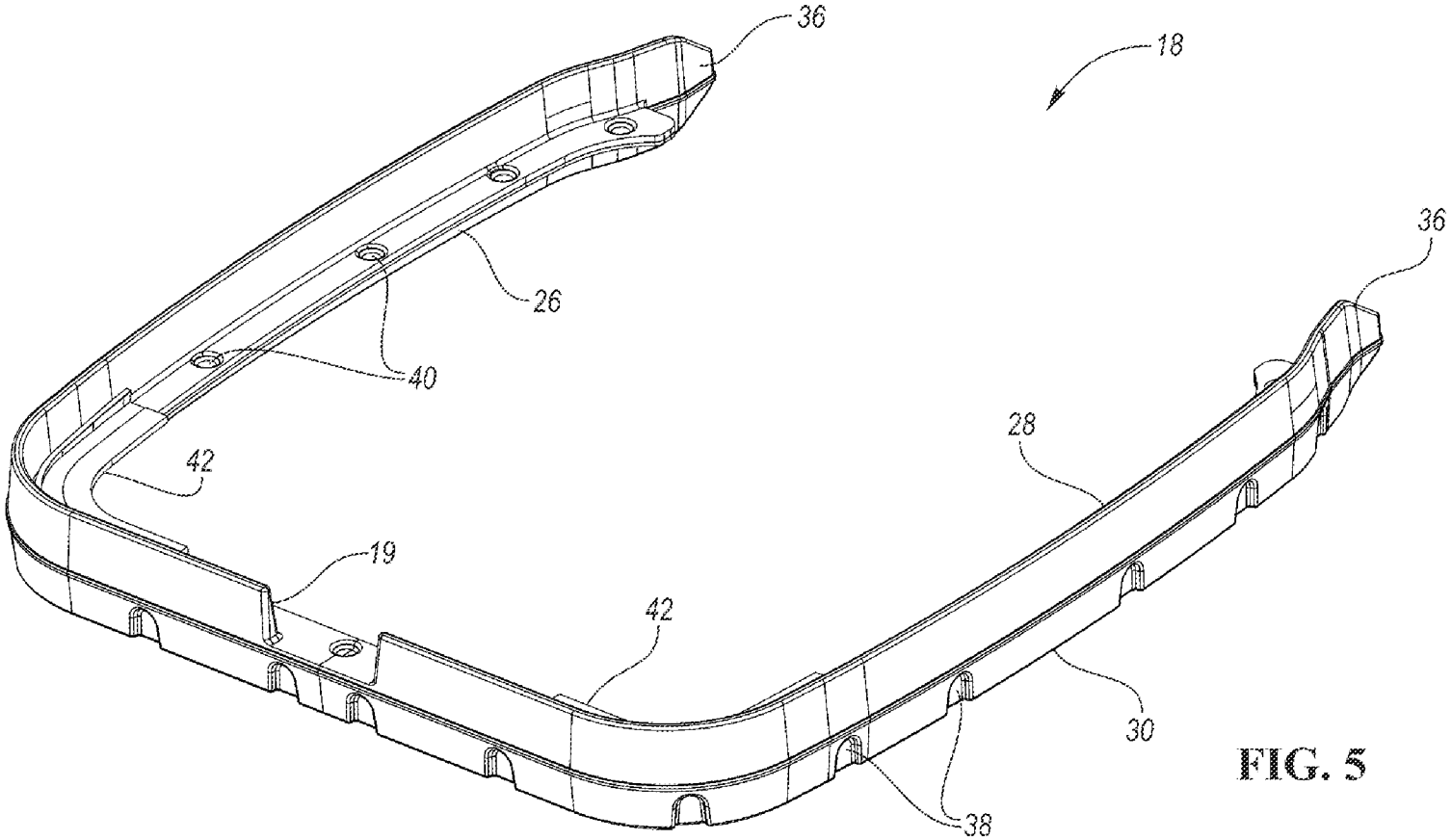
FIG. 5 is a perspective view of the collar of FIG. 1.

FIG. 5 is a perspective view of the collar 18. The collar 18 is generally U-shaped and adapted to be secured to the lip 24 at the front and sides of the container body 12 (FIG. 2). The horizontal portion 26, upper peripheral flange 28 and lower peripheral flange 30 extend continuously about the periphery of the three sides of the container body 12, with the exception of the small gap 19 through the upper peripheral flange 28 in the center of the front side. The recesses 40 are formed about the entire periphery of the upper surface of the horizontal portion 26. The recesses 38 are formed about the entire periphery of the outer surface of the lower peripheral flange 30. As shown, the upper peripheral flange 28 and lower peripheral flange 30 form hinge covers 36 at rear ends of the collar 18. The horizontal portion 26 does not extend onto the hinge covers 36.

Figure 6:
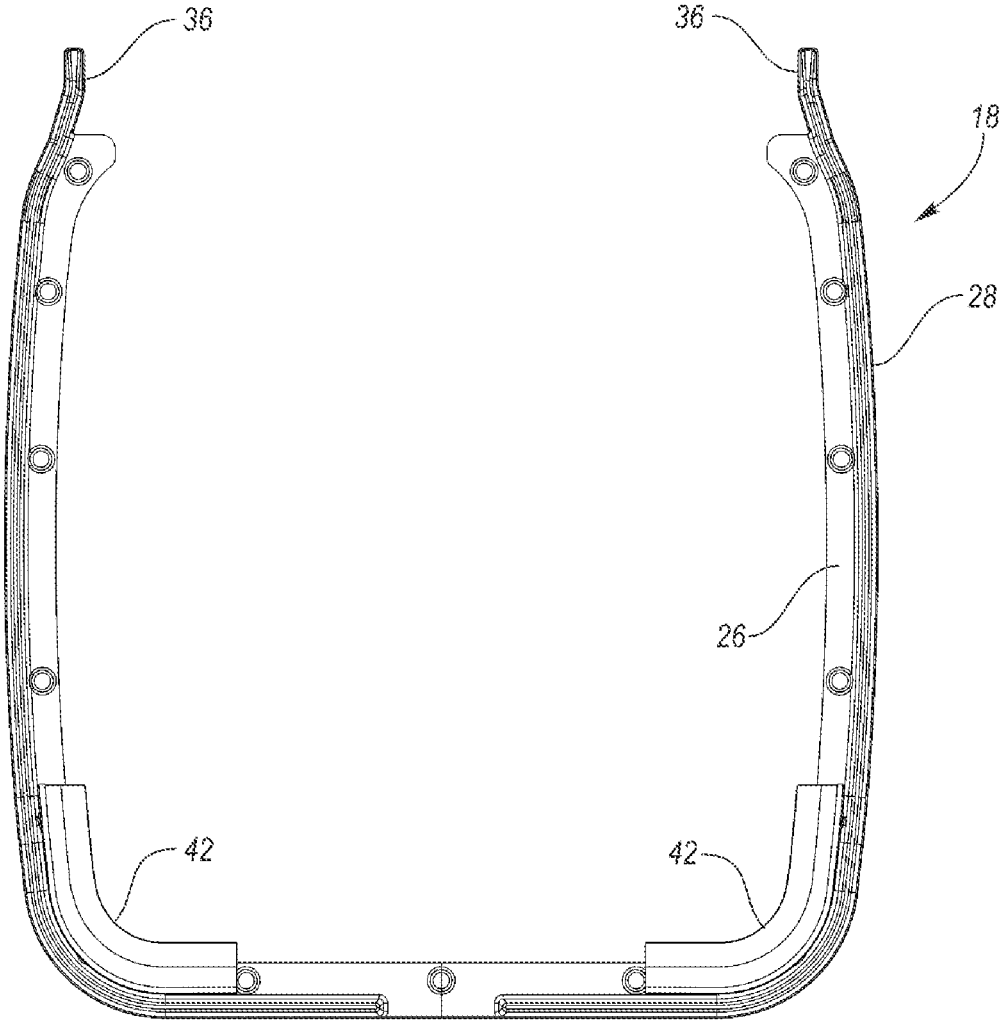
FIG. 6 is a top view of the collar of FIG. 5.

As can be seen in FIGS. 5 and 6, there are optional L-shaped reinforcement members 42 in the corners of the collar 18 to add stiffness between the upper peripheral flange 28 and the horizontal portion and between the lower peripheral flange 30 and the horizontal portion 26. The reinforcement members 42 may be another layer of the thermoformed upper sheet and as shown may be wider than the rest of the horizontal portion 26.

Figure 7:
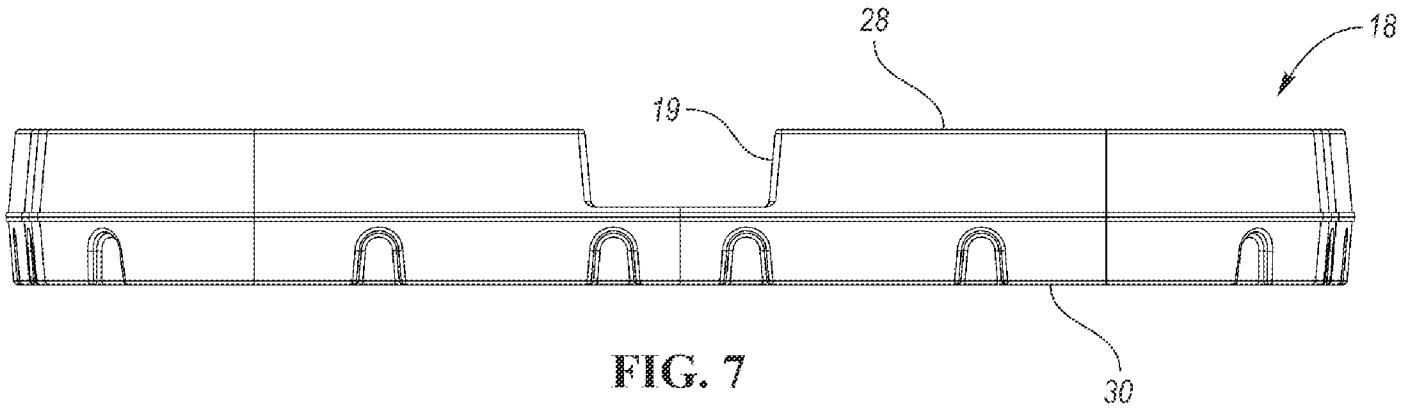
FIG. 7 is a front view of the collar of FIG. 5.
Figure 8:
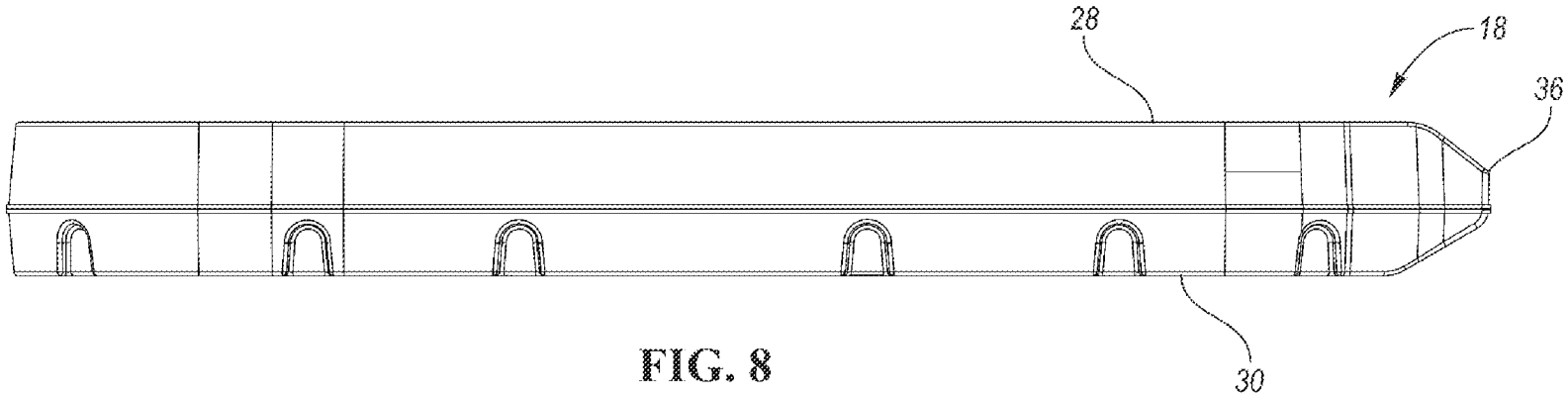
FIG. 8 is a side view of the collar of FIG. 5.

FIG. 7 is a front view of the collar 18, showing the gap 19. FIG. 8 is a side view of the collar 18.

Figure 9:
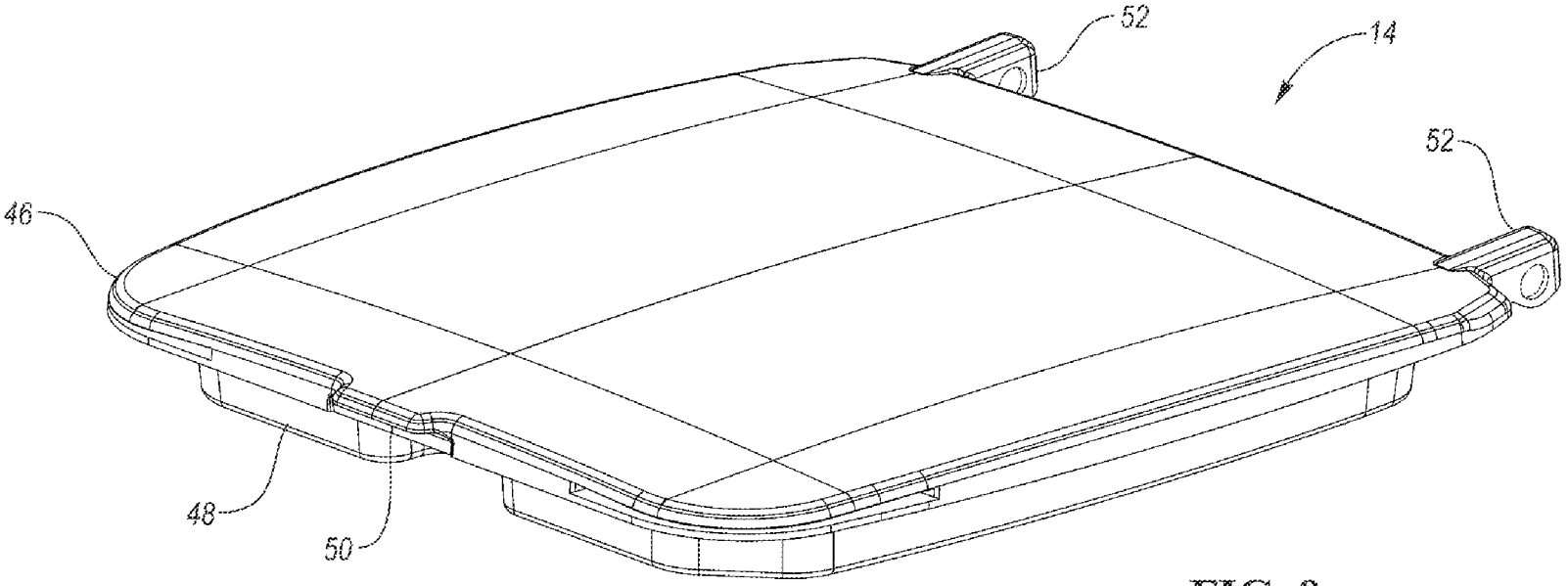
FIG. 9 is a perspective view of the lid of FIG. 1.

FIG. 9 is a perspective view of the lid 14. The lid 14 may also be a twin-sheet thermoformed design with kiss off points for strength. Alternatively, the lid 14 may be injection molded or rotomolded as a single piece of plastic. The lid 14 includes a generally planar cover portion 46 formed of one sheet and a lower rim 48 (formed of a second sheet) projecting downward from the cover portion 46. A lift tab 50 projects forward from a center of the cover portion 46. Hinge members 52 project rearward of the cover portion 46 for hinged attachment to the container body 12 (FIG. 1).

The lower rim 48 extends about the entire periphery of the cover portion 46 but is spaced inward of the periphery of the cover portion 46. The lower rim 48 is sized and configured to be received within the mouth of the container body 12 (FIG. 1). The lower rim 48 is only slightly smaller than the inner dimensions of the mouth of the container body 12, such that the lower rim 48 also reinforces the mouth of the container body 12 against deformation (such as by a bear). The cover portion 46 is sized and configured to be received within the upper peripheral flange 28 of the collar 18 and to rest on the horizontal portion 26 of the collar 18. The lift tab 50 is positioned to align with the gap 19 in the upper peripheral flange 28, such that a user could get fingers under the lift tab 50 to lift the lid 14. This is shown in FIG. 1.

Figure 11:
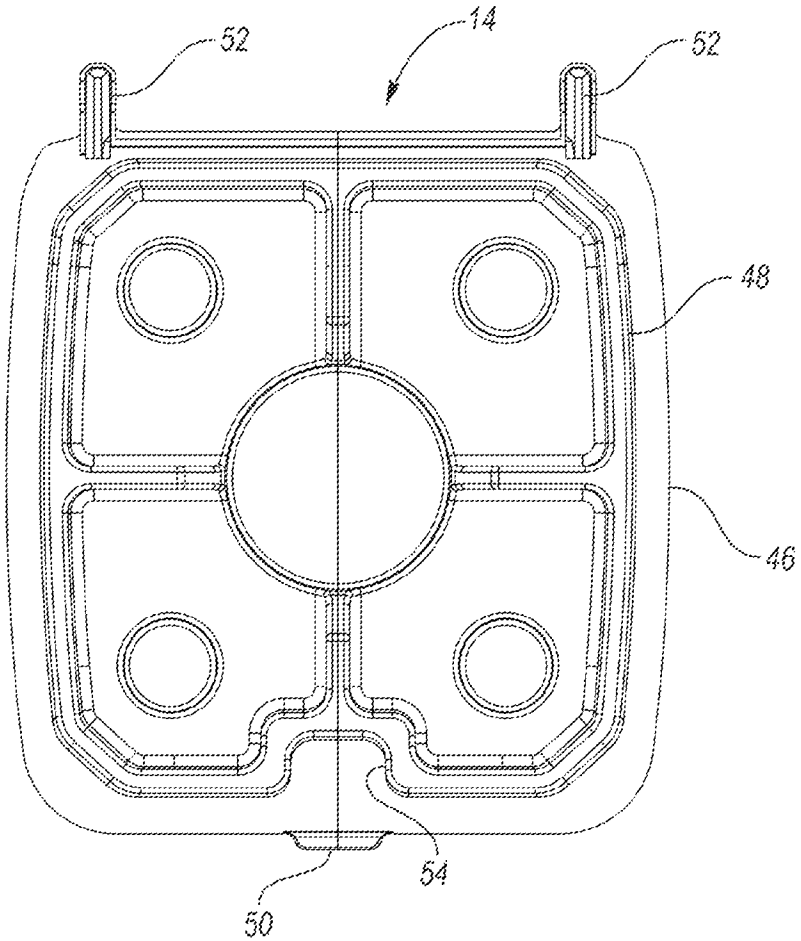
FIG. 11 is a bottom view of the lid of FIG. 9.
Figure 10:
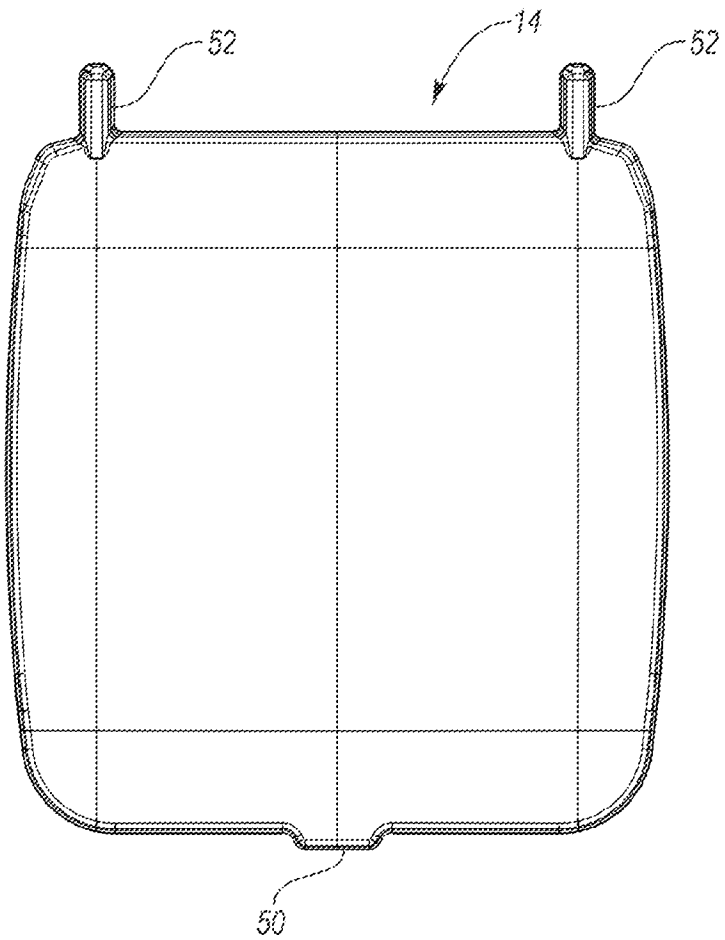
FIG. 10 is a top view of the lid of FIG. 9.

FIG. 10 is a top view of the lid 14. FIG. 11 is a bottom view of the lid 14. Referring to FIG. 11, the lower rim 48 extends about the entire periphery of the cover portion 46 but is spaced inward of the periphery of the cover portion 46. At the front edge of the lid 14, the lower rim 48 juts inward to accommodate latch hardware.

Figure 12:
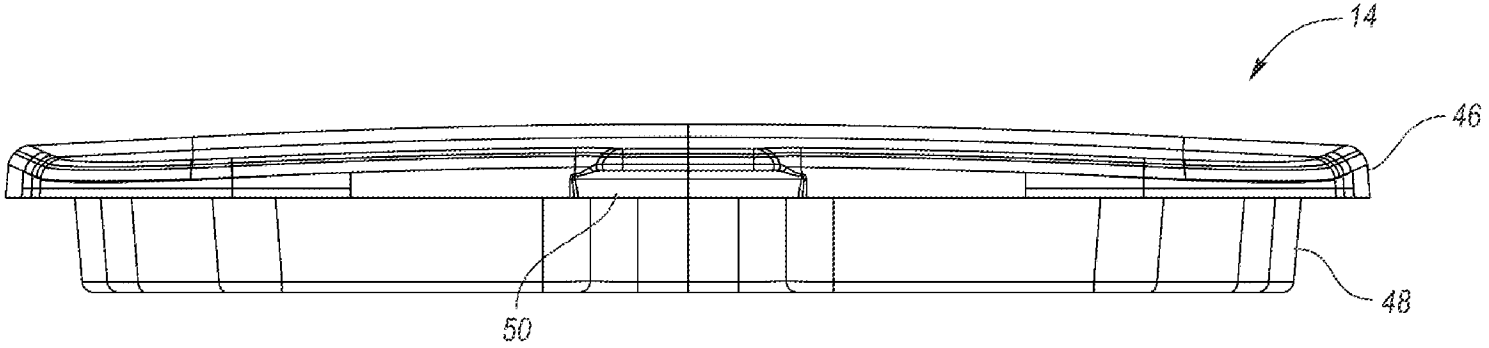
FIG. 12 is a front view of the lid of FIG. 9.
Figure 13:
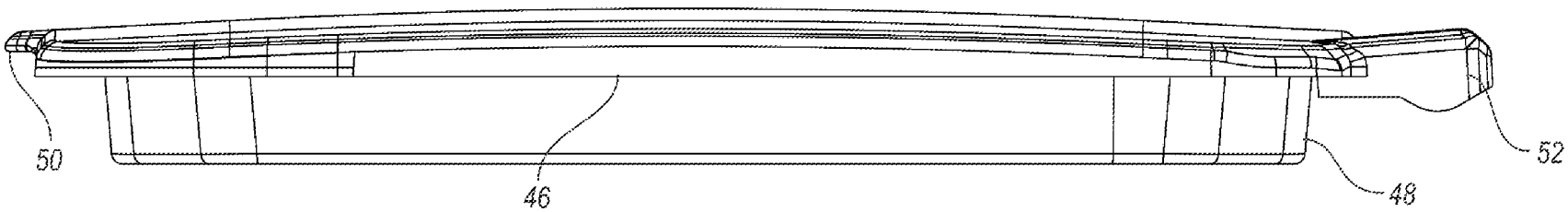
FIG. 13 is a side view of the lid of FIG. 9.

FIG. 12 is a front view of the lid 14. FIG. 13 is a side view of the lid 14 showing the lift tab 50 projecting from a front edge of the cover portion 46 and one of the hinge members 52 projecting from a rear edge of the cover portion 46.

Figure 14:
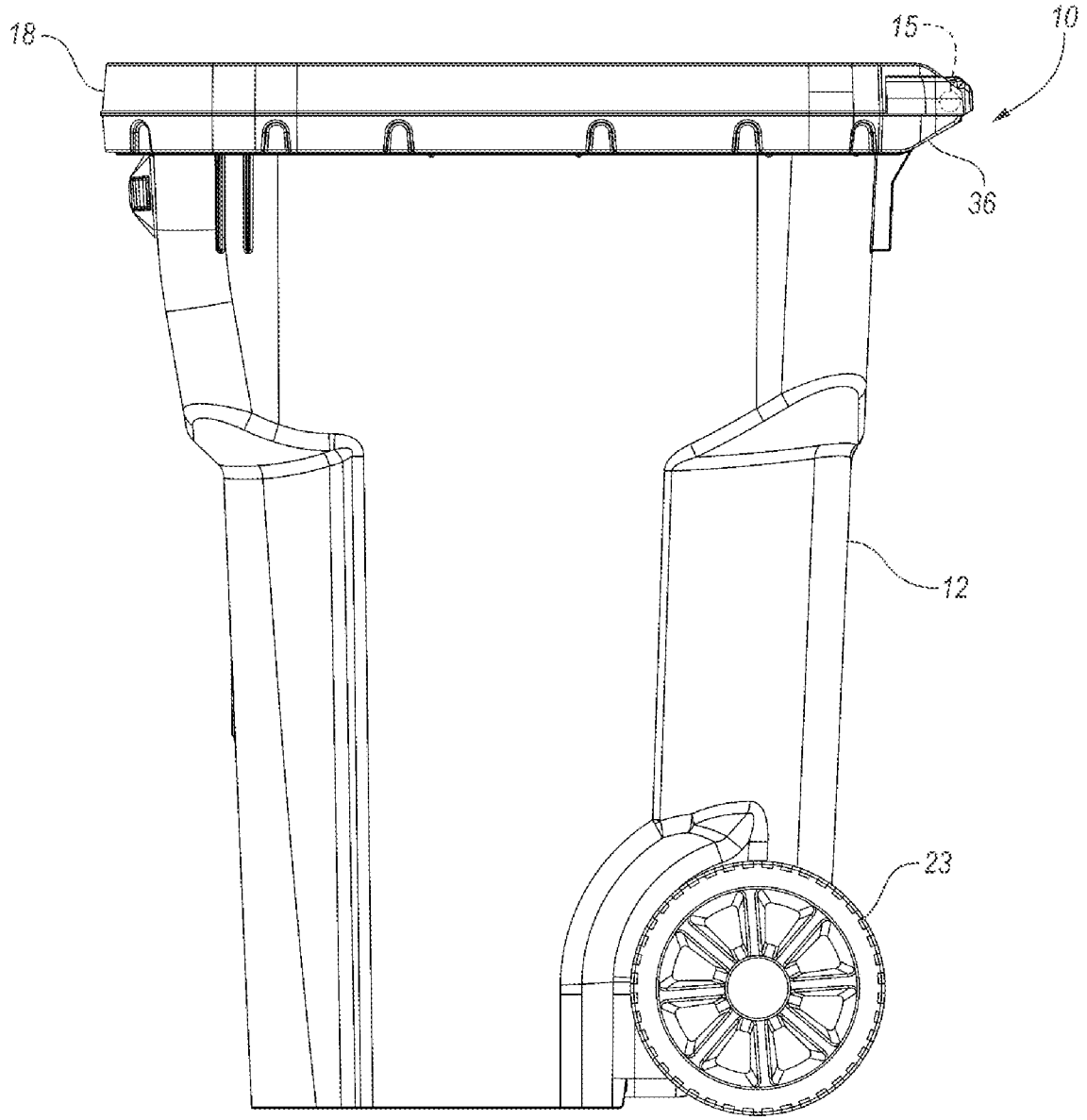
FIG. 14 is a side view of the roll-out cart of FIG. 1.

FIG. 14 is a side view of the roll-out cart 10. Although the lid 14 in this embodiment is completely recessed below an uppermost edge of the collar 18, and although that is preferred, it may be sufficient for the lid 14 to be only partially recessed within the collar 18.

The collar 18 and the lower rim 48 of the lid 14 both reinforce the mouth of the container body 12 against deformation, such as by a bear pressing on the front or side of the container body 12. The lower rim 48 of the lid 14 also prevents intrusion between the lid 14 and the container body 12 by an animal, such as a bear.

Figure 15:
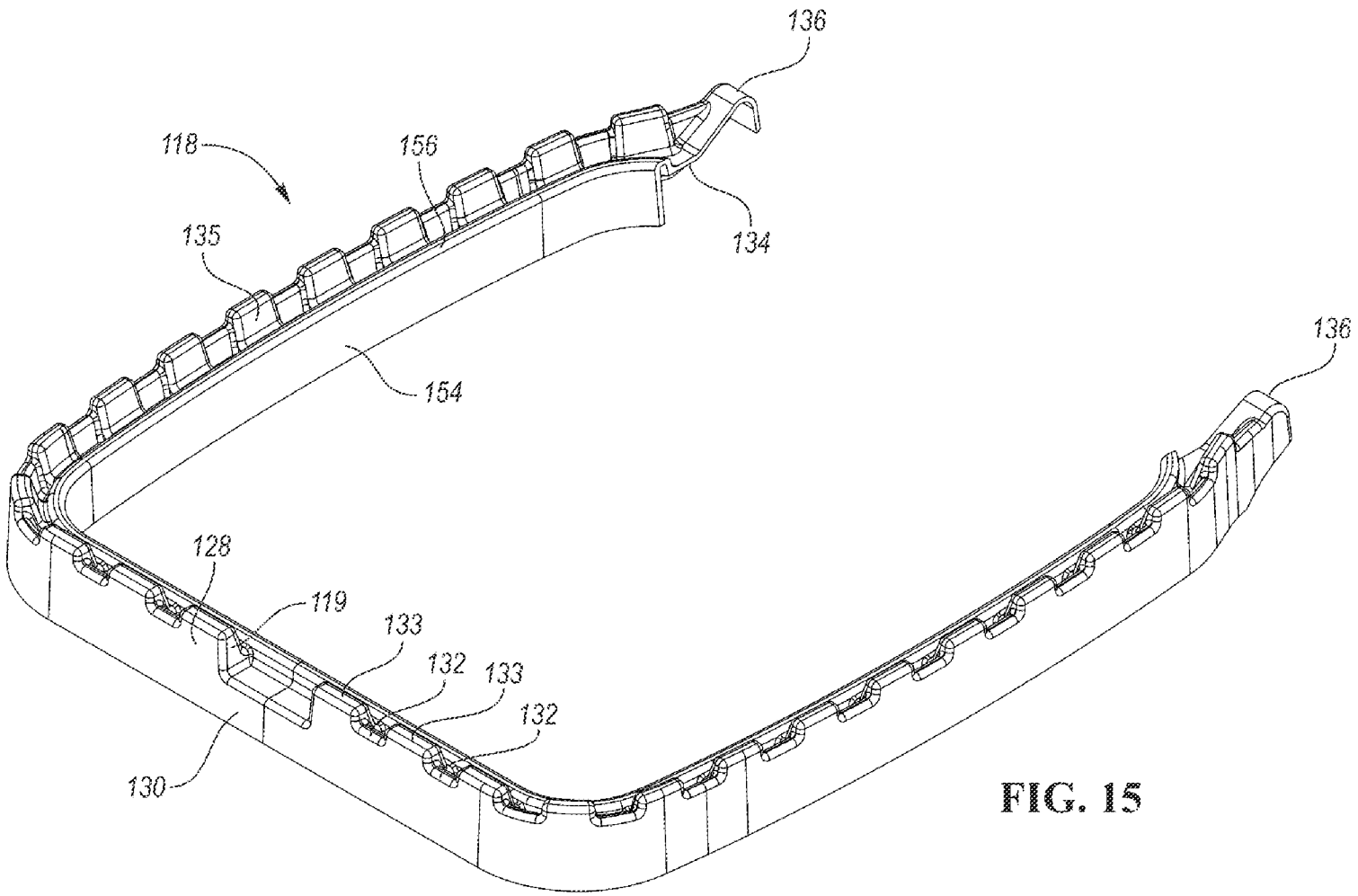
FIG. 15 is a front perspective view of a collar according to a second embodiment.

FIG. 15 is a front perspective view of a collar 118 according to a second embodiment. This example collar 118 is formed via thermoforming a single sheet of plastic, but it could also be injection molded as a single piece of plastic. The collar 118 is generally U-shaped, having two side portions extending rearwardly from a front portion. The collar 118 includes an upper peripheral flange 128 and a lower peripheral flange 130, which in this example are joined continuously to form an outer surface of the collar 118.

An inner wall 135 is spaced inward of the upper peripheral flange 128 and extends downward to a lower horizontal portion 134. An upper wall connects upper edges of the upper peripheral flange 128 and inner wall 135. An upper edge of the collar 118 (including the upper peripheral flange 128, inner wall 135 and the upper wall connecting the inner wall 135 to the upper peripheral flange 128) is crenellated to form peaks 133 and valleys 132.

Figure 16:
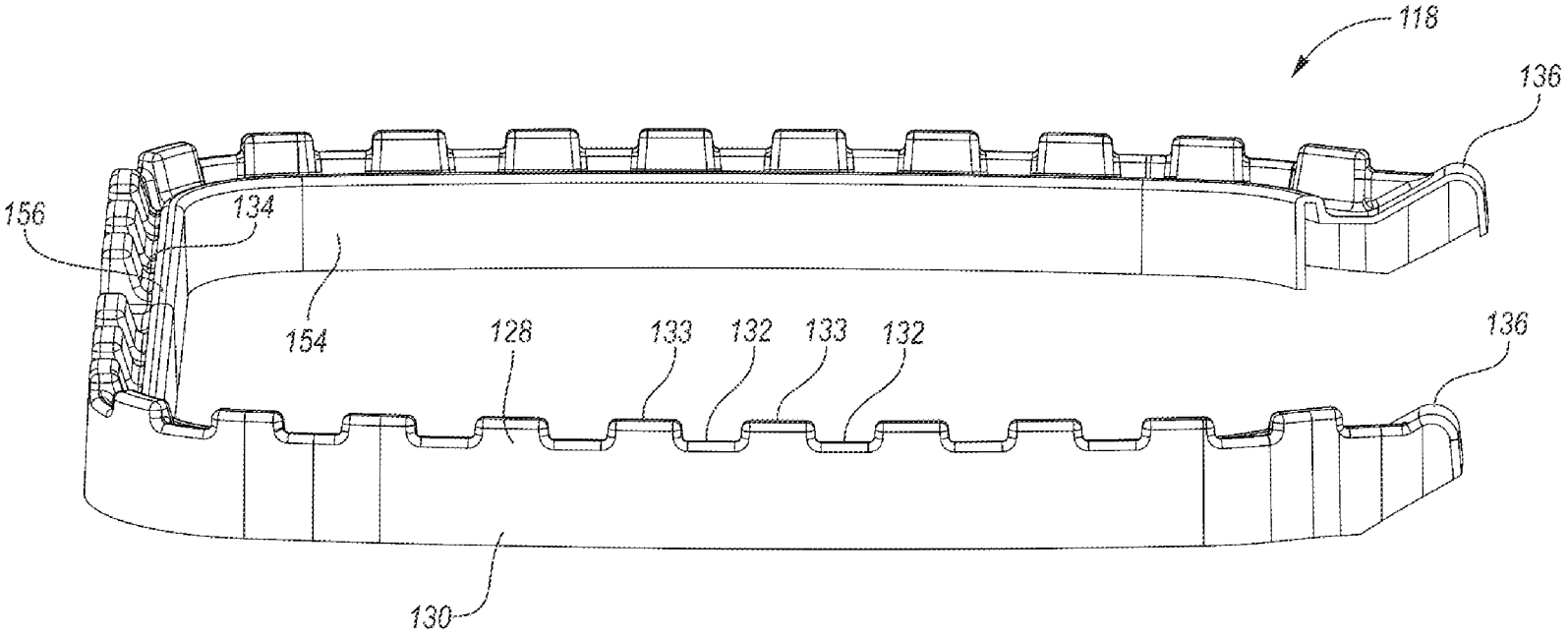
FIG. 16 is a side perspective view of the collar of FIG. 15.

A hollow inner peripheral flange 156 projects upward from an inner edge of the lower horizontal portion 134 and opens downward. An inner peripheral wall 154 extends downward from an inner edge of the inner peripheral flange 156. Rear ends of the side portions of the collar 118 form hollow hinge covers 136 opening toward one another. FIG. 16 is a side perspective view of the collar of FIG. 15.

Figure 17:
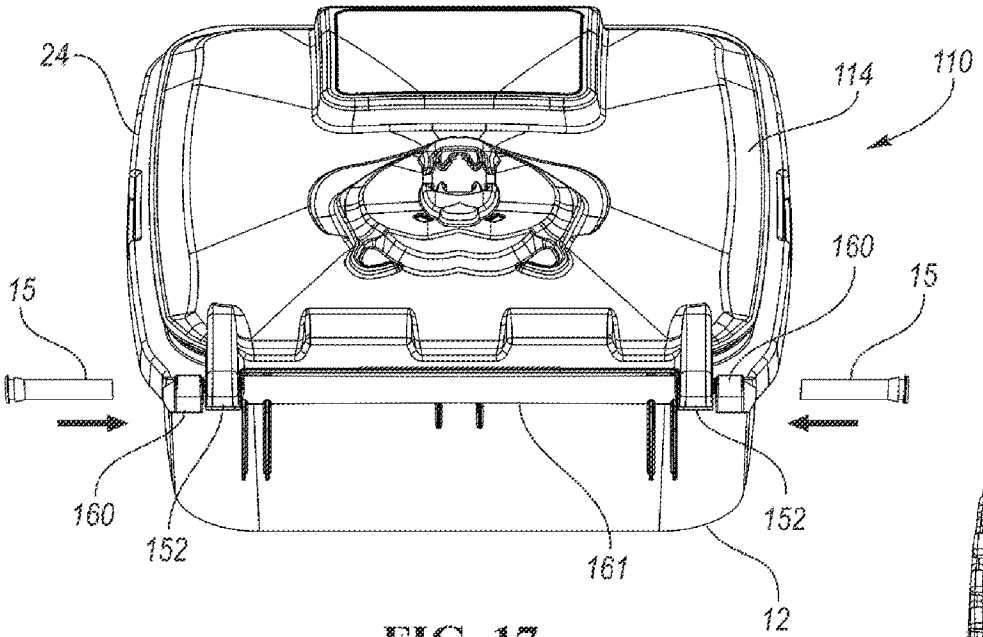
FIG. 17 shows the assembly of the hinge pins into a roll-out cart.

FIG. 17 shows the assembly of the hinge pins 15 into a roll-out cart 110, including the container body 12 from FIG. 1 and an alternate lid 114. The container body 12 includes integrally-molded hinge members 160 positioned adjacent hinge members 152 of the lid 114. The hinge pins 15 are then inserted into the hinge members 152, 160 to secure the lid 114 and hinge members 160 to a handle 161 spaced rearwardly of a rear wall of the container body 12. After the hinge pins 15 are inserted to secure the lid 114 to the handle 161 and the container body 12, the collar 118 is installed on the roll-out cart 110 as shown in FIG. 18.

Figure 18:
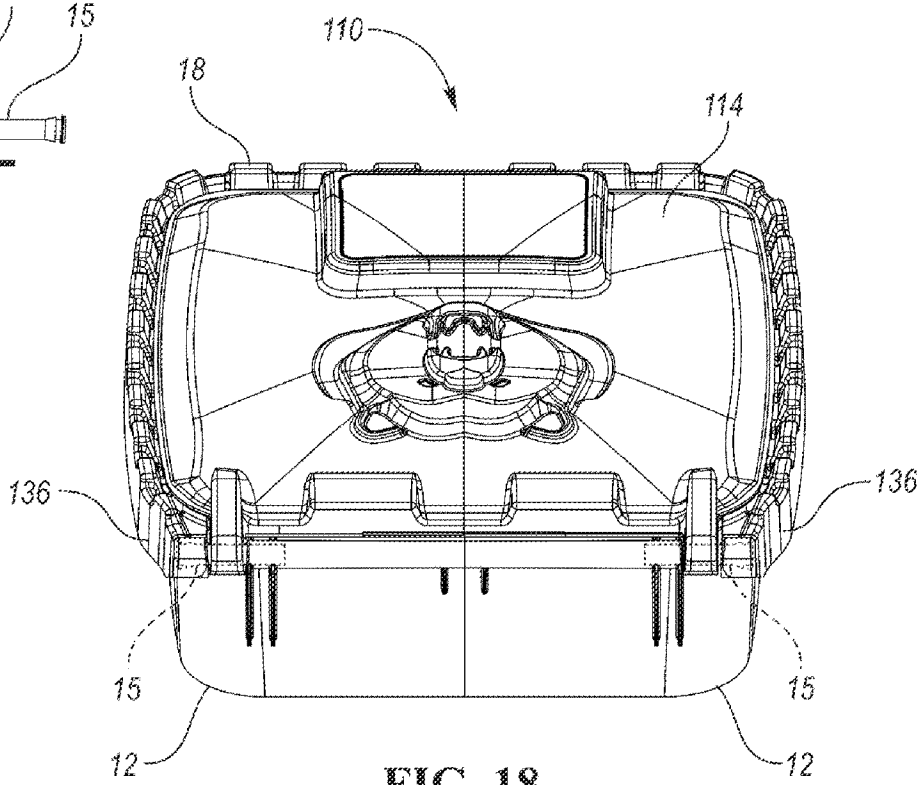
FIG. 18 shows the collar of FIG. 15 installed on the roll-out cart of FIG. 17.

FIG. 18 shows the collar 118 of FIG. 15 installed on the roll-out cart 110 of FIG. 17. The collar 118 covers the lip 24 of the container body 12 and the hinge covers 136 of the collar 118 cover the hinge pins 15. The collar 118 may be secured to the lip 24 by adhesive and/or fasteners, such as rivets or screws.

Figure 19:
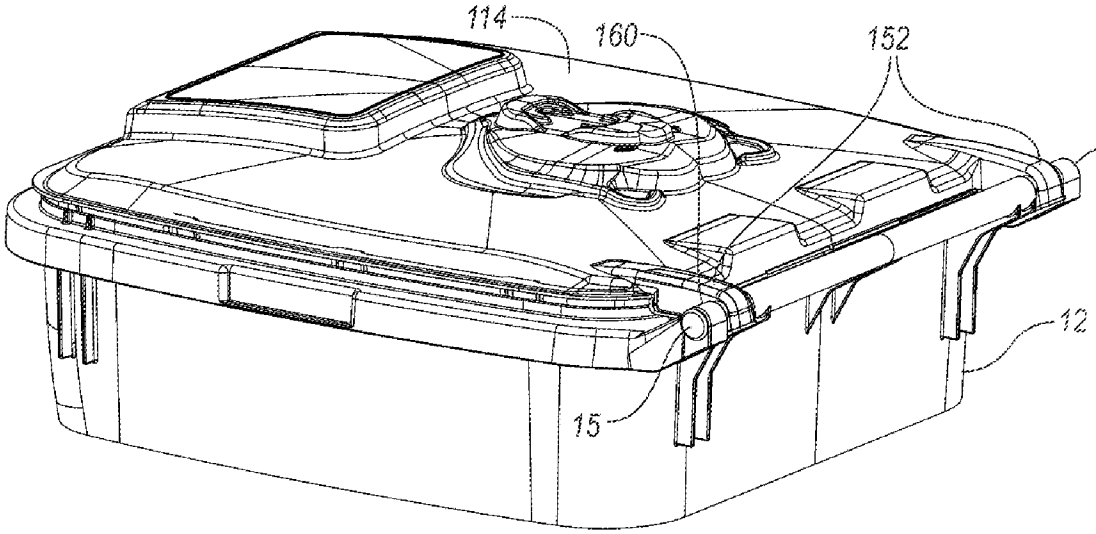
FIG. 19 is a rear perspective view of the roll-out cart of FIG. 17 with the hinge pins installed.
Figure 20:
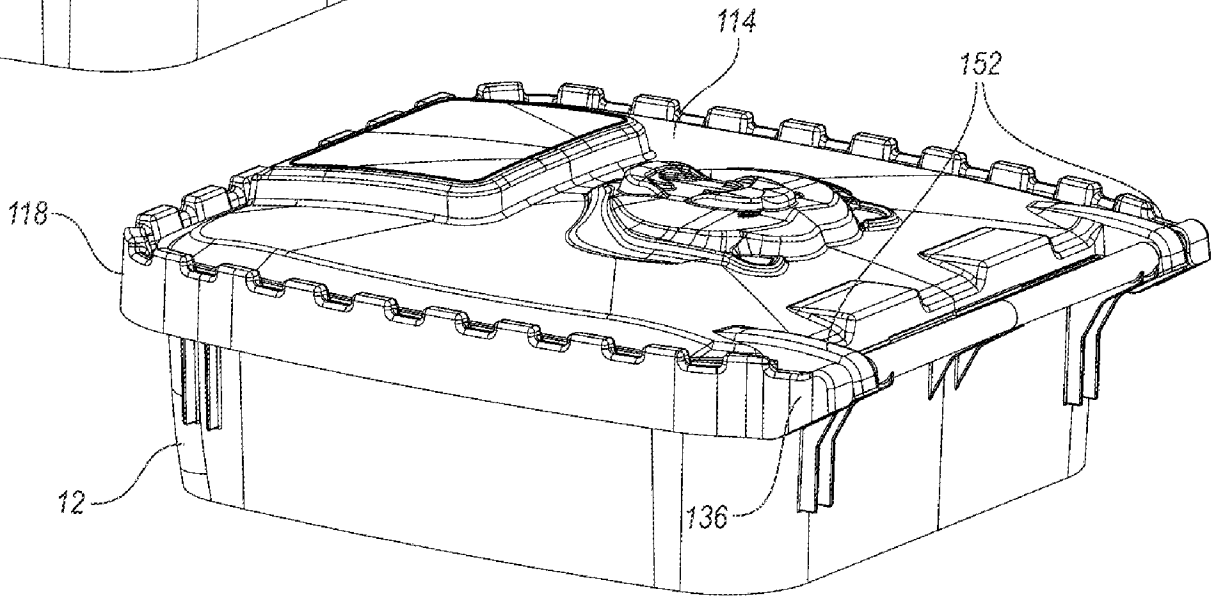
FIG. 20 is a rear perspective view of the roll-out cart including the collar of FIG. 18.

FIG. 19 is a rear perspective view of the roll-out cart 110 of FIG. 17 with the hinge pins 15 installed. FIG. 20 is a rear perspective view of the roll-out cart 110 including the collar 118 of FIG. 18. The collar 118 covers the lip 24 of the container body 12 and the hinge covers 136 of the collar 118 cover the hinge pins 15. As shown in FIG. 20, the lid 114 is substantially recessed relative to upper edges of the collar 118. This helps prevent animals, such as bears, from prying the lid 114 away from the container body 12.

Figure 21:
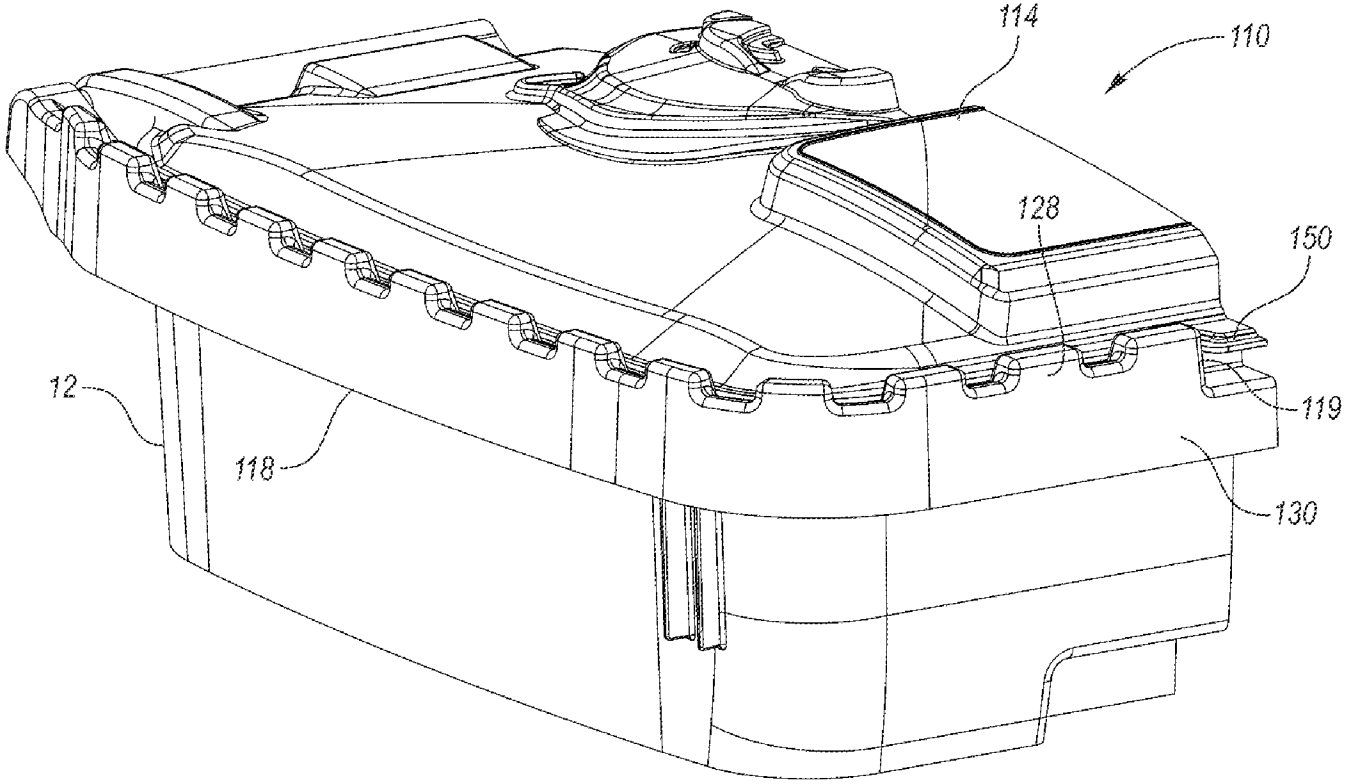
FIG. 21 is a front perspective view of the roll-out cart of FIG. 20, partially broken away along a longitudinal midline.

FIG. 21 is a front perspective view of the roll-out cart 110 of FIG. 20, partially broken away along a longitudinal midline. The upper peripheral flange 128 extends upward higher than the adjacent surfaces of the lid 114 except within a gap 119 into which projects a lift tab 150 of the lid 114.

Figure 22:
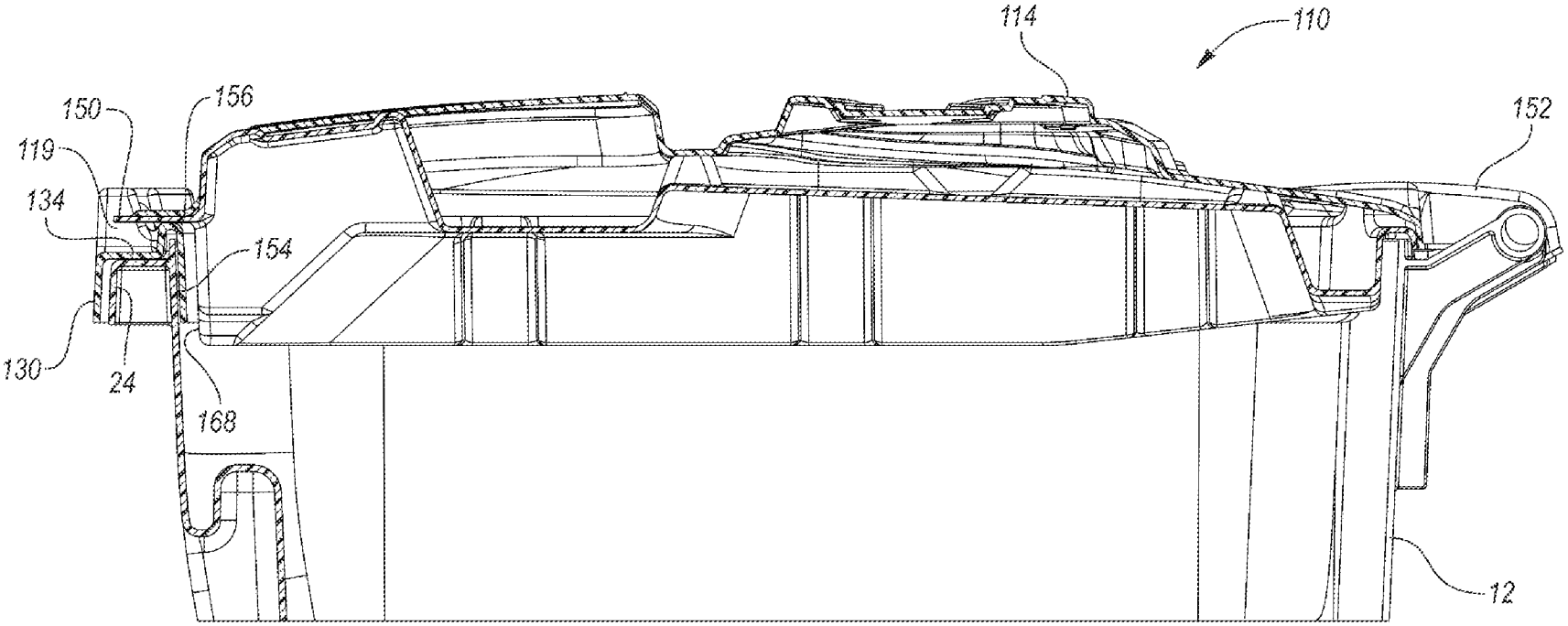
FIG. 22 is a side view of the roll-out cart of FIG. 21, partially broken away.

FIG. 22 is a side view of the roll-out cart 110 of FIG. 21, partially broken away. The lower peripheral flange 130 is outward of and adjacent to the lip 24. The lower horizontal portion 134 rests on the horizontal portion of the lip 24. The hollow inner peripheral flange 156 receives a small peripheral flange of the container body 12 projecting upward at an inner peripheral edge of the lip 24. The inner peripheral wall 154 of the collar 118 projects downward along an inner surface of the upper edge of the wall of the container body 12.

The lift tab 150 projects into the gap 119 of the collar 118. The lid 114 includes a lower vertical wall 168 that is received adjacent the inner surface of the upper edge of the wall of the container body 12 and more particularly adjacent the inner surface of the inner peripheral wall 154 when the lid 114 is closed. In this manner, the lid 114 reinforces the mouth of the container body 12.

Figure 23:
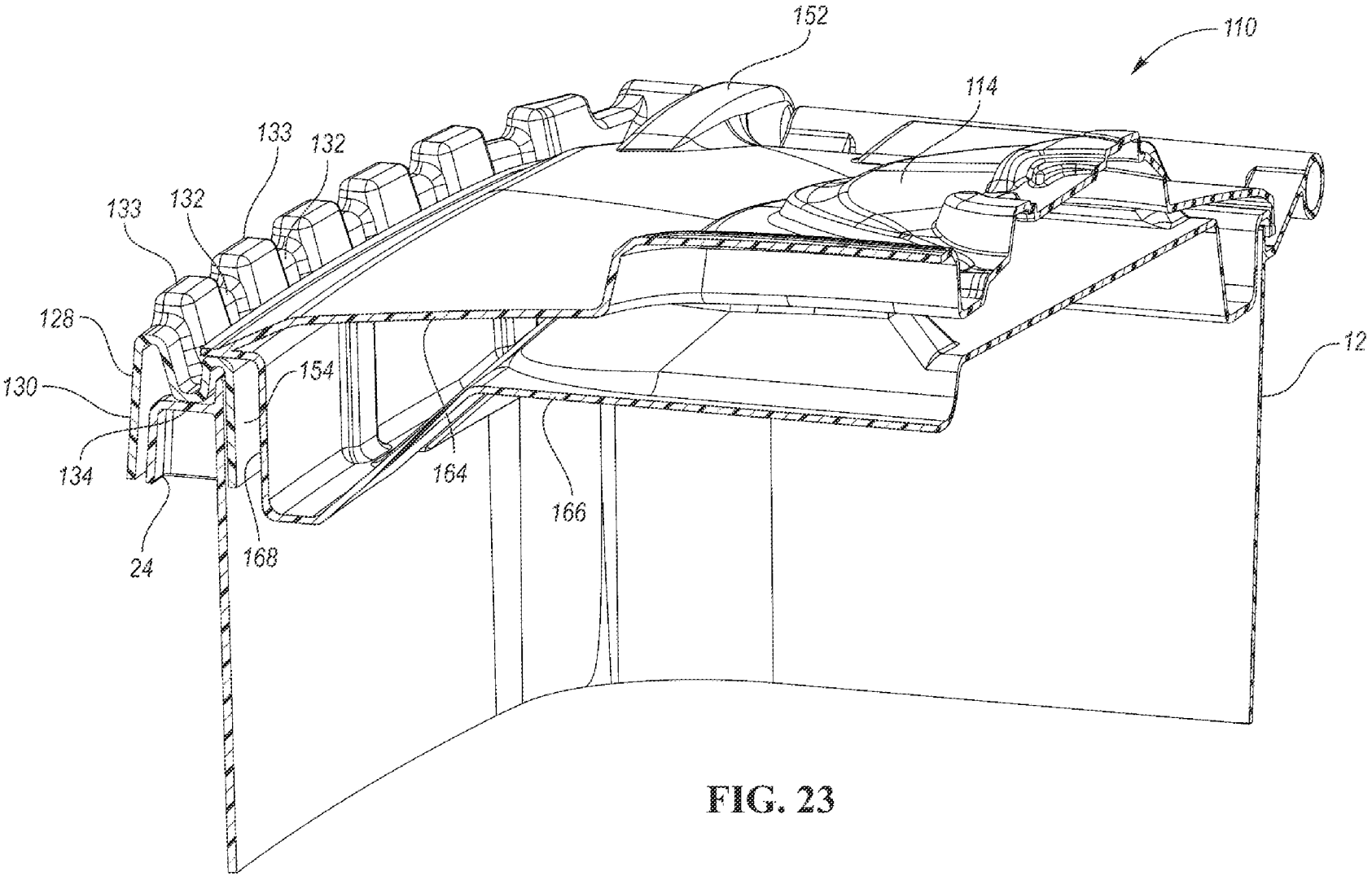
FIG. 23 is a perspective view of the roll-out cart of FIG. 21, partially broken away along longitudinal and lateral mid-lines.

FIG. 23 is a perspective view of the roll-out cart 110 of FIG. 21, partially broken away along longitudinal and lateral mid-lines. The lid 114 in this example is formed in a twin-sheet thermoforming process. The upper sheet 164 forms an upper surface of the lid 114 and the lower sheet 166 forms a lower surface of the lid 114 and the lower vertical wall 168.

Figure 24:
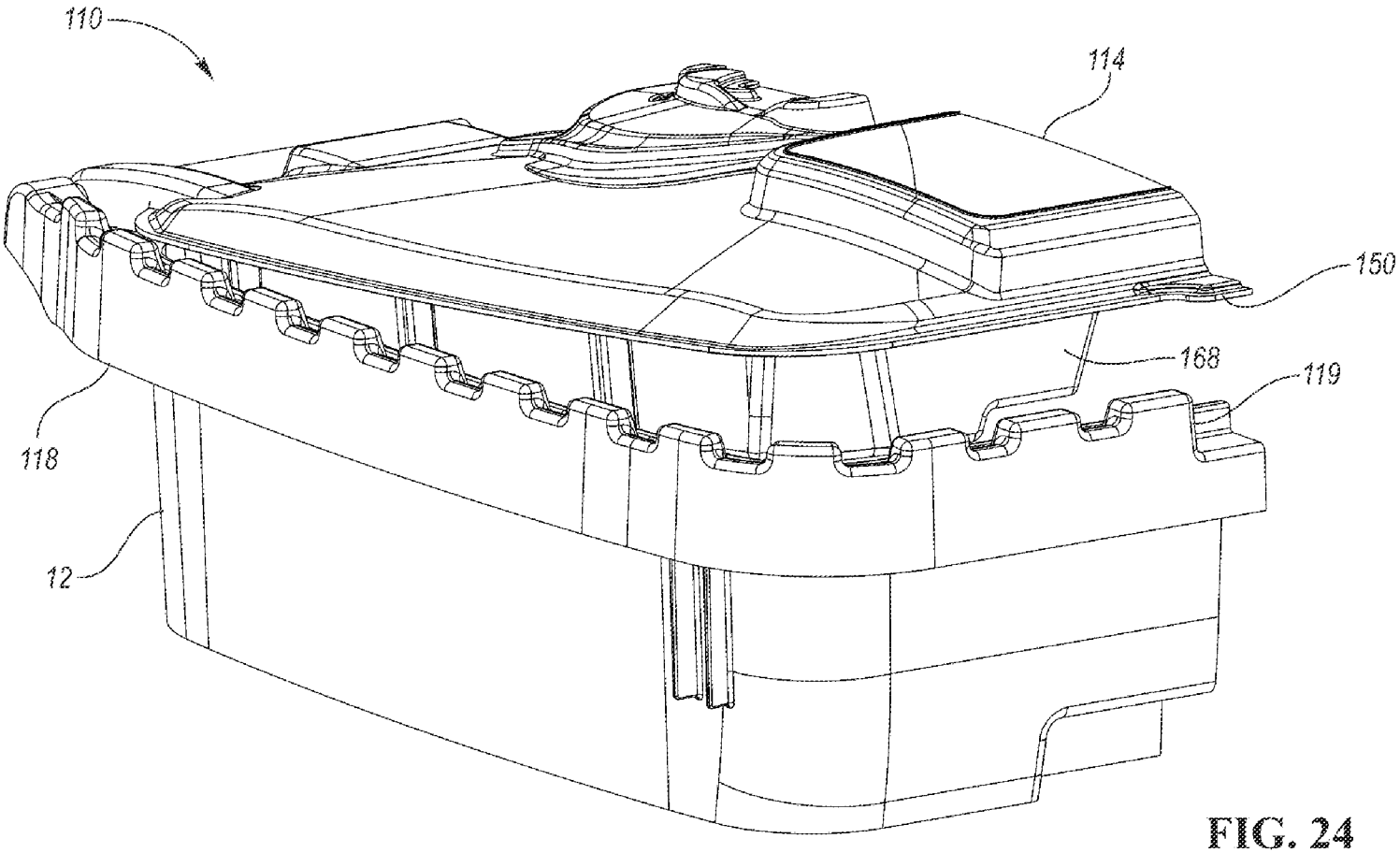
FIG. 24 is a perspective view of the roll-out cart of FIG. 21 with the lid partially open.
Figure 25:
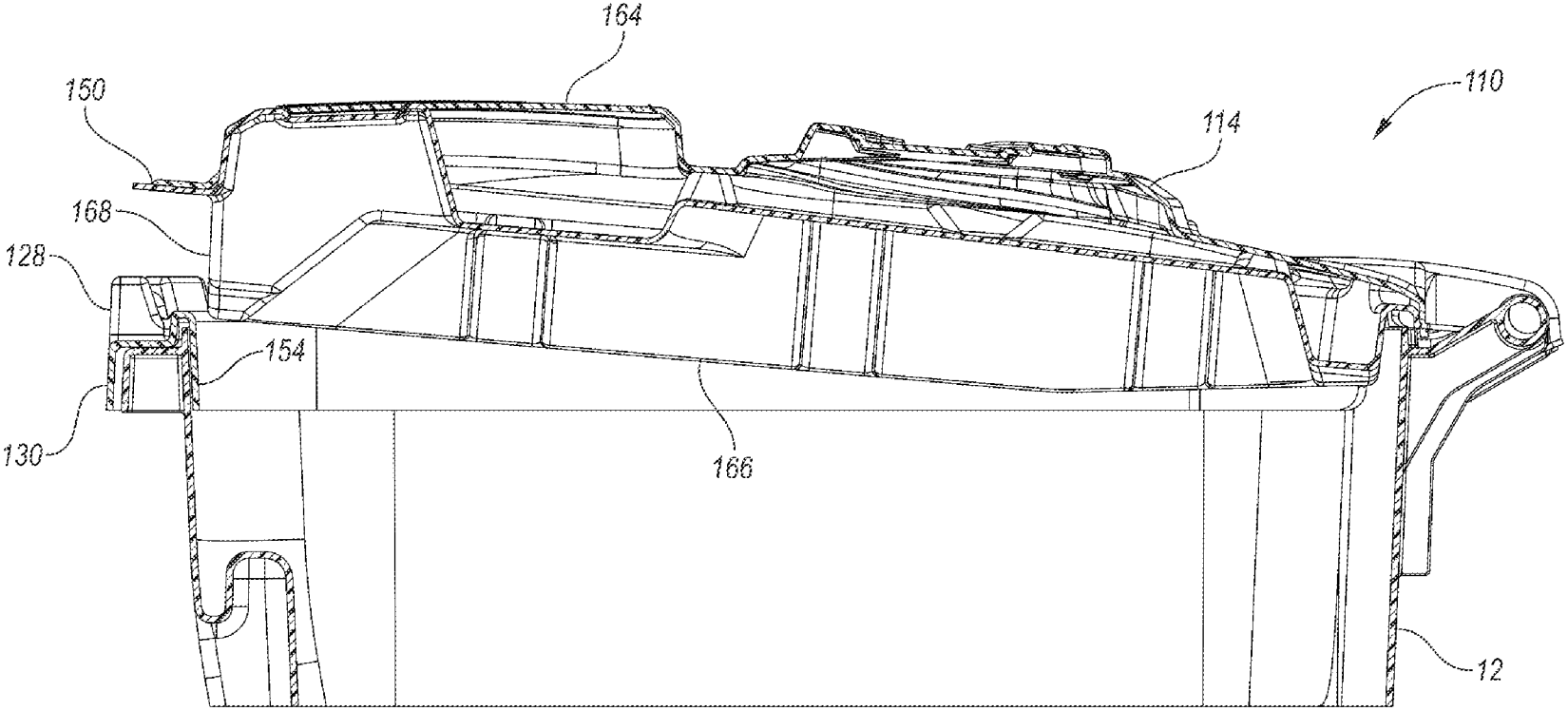
FIG. 25 is a side view of the roll-out cart of FIG. 24.

FIG. 24 is a perspective view of the roll-out cart 110 of FIG. 21 with the lid 114 partially open. FIG. 25 is a side view of the roll-out cart 110 of FIG. 24. Referring to FIGS. 24 and 25, the lower vertical wall 168 extends about the front and sides of the lid 114 to reinforce the mouth of the container body 12 and to prevent intrusion under the lid 114 (such as by a claw).

Figure 26:
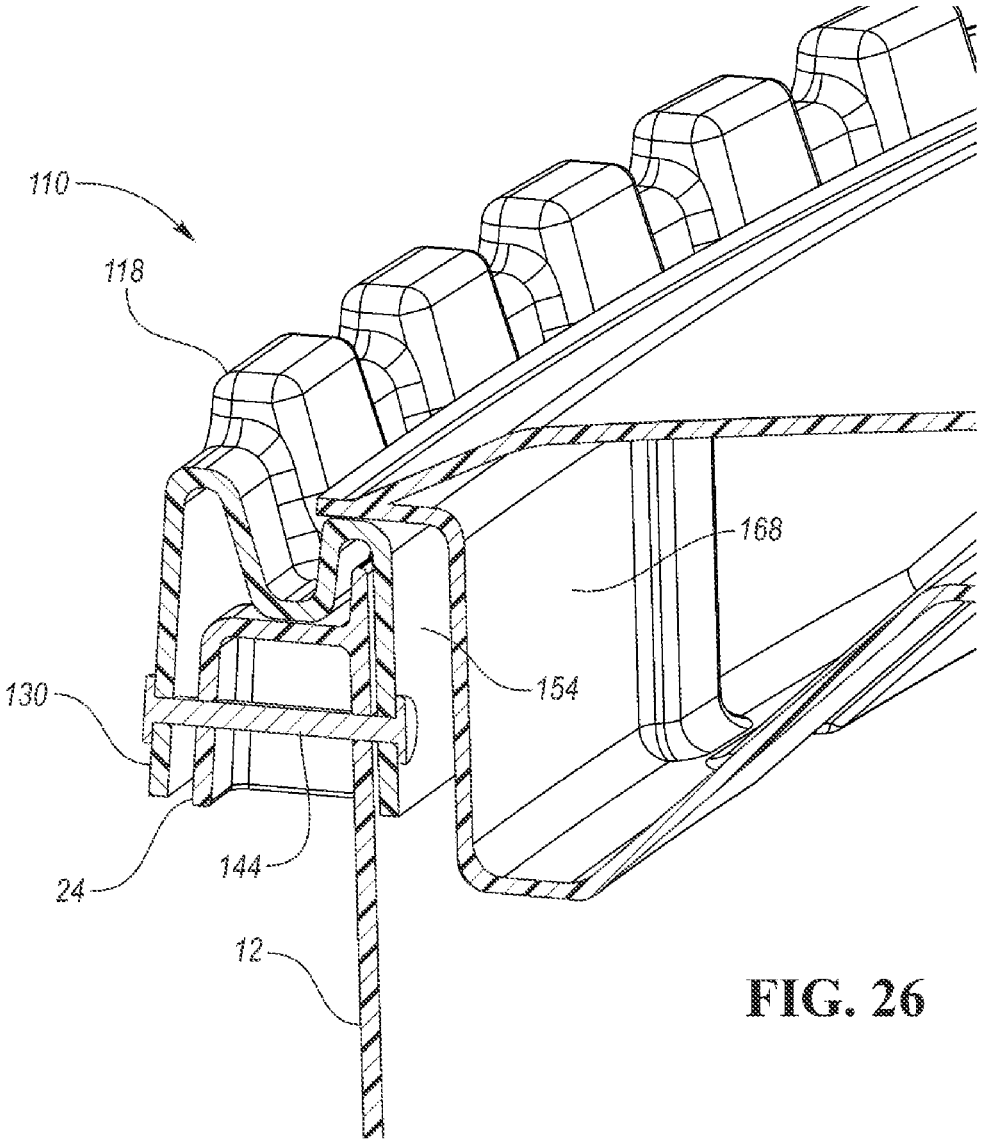
FIG. 26 is a perspective view, partially broken away, showing one way to connect the collar to the container body.

FIG. 26 is a perspective view, partially broken away, showing one way to connect the collar 118 to the container body 12. A plurality of fasteners, such as bolts 144 extend through the inner peripheral wall 154 of the collar 118, through the side wall of the container body 12, then through the lip 24, and then through the lower peripheral flange 130 of the collar 118, i.e. twice through the container body 12 and twice through the collar 118. A plurality of bolts 144 (e.g. eight) are connected in this manner about the periphery of the collar. Alternatively, screws, rivets, and/or adhesives could be used.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container assembly comprising:

a container body having a side wall extending upward from a base to define a mouth, the container body including a lip extending outward and downward at an upper edge of the side wall;

a lid pivotably secured to the container body and pivotable between an open position and a closed position over the mouth of the container body; and a collar secured to the lip of the container body, the collar including a horizontal portion secured to an upper surface of the lip, an upper peripheral flange projecting upward from the horizontal portion, wherein the upper peripheral flange includes a gap at a front edge of the container body and the lid includes a lift tab projecting forward of the container body, wherein the lift tab is accessible via the gap in the upper peripheral flange.

2. The container assembly of claim 1 wherein the collar includes a lower peripheral flange projecting downward from the horizontal portion.

3. The container assembly of claim 2 wherein the collar extends about three sides of the mouth of the container body, but not a fourth side of the mouth of the container body.

4. The container assembly of claim 3 wherein the lid is recessed within the upper peripheral flange when the lid is in the closed position.

5. The container assembly of claim 4 wherein the lid is recessed completely below an upper edge of the upper peripheral flange.

6. The container assembly of claim 4 wherein the lower peripheral flange is secured to a vertical portion of the lip of the container body.

7. The container assembly of claim 1 wherein the lid is recessed below an upper edge of the collar.

8. The container assembly of claim 1 wherein the collar extends about three sides of the mouth of the container body, but not a fourth side of the mouth of the container body.

9. The container assembly of claim 8 wherein the container body includes a lip extending outward and downward at an upper edge of the side wall and wherein the collar is secured to the lip of the container body.

10. The container assembly of claim 9 further including wheels mounted to a lower rear portion of the container body.

11. The container assembly of claim 1 further including:

wheels mounted to a lower rear portion of the container body;

a handle spaced rearwardly of the container body, wherein the lid is pivotably secured to the handle; and a latch configured to connect a front portion of the lid to a front portion of the container body.

12. A container assembly comprising:

a container body having a side wall extending upward from a base to define a mouth, the container body including a lip extending outward and downward at an upper edge of the side wall;

a lid pivotably secured to the container body and pivotable between an open position and a closed position over the mouth of the container body; and a collar secured to the lip of the container body, the collar including a horizontal portion secured to an upper surface of the lip and the collar including a lower peripheral flange projecting downward from the horizontal portion, the collar including an upper peripheral flange projecting upward from the horizontal portion, wherein the collar is twin-sheet thermoformed.

13. The container assembly of claim 12 wherein the horizontal portion of the collar includes an upper horizontal portion and a lower horizontal portion, wherein the upper horizontal portion and the upper peripheral flange together are a first sheet and wherein the lower horizontal portion and the lower peripheral flange together are a second sheet, wherein the upper horizontal portion is joined to the lower horizontal portion in a twin-sheet thermoforming process.

14. The container assembly of claim 12 further including:

wheels mounted to a lower rear portion of the container body;

a handle spaced rearwardly of the container body, wherein the lid is pivotably secured to the handle; and a latch configured to connect a front portion of the lid to a front portion of the container body.

15. A collar for reinforcing a mouth of a container comprising:

a horizontal portion having a pair of side portions extending from a front portion;

a lower peripheral flange projecting downward from an outer edge of the horizontal portion; and an upper peripheral flange projecting upward from the outer edge of the horizontal portion;

wherein the lower peripheral flange and the upper peripheral flange are also U-shaped having a pair of side portions extending rearward from a front portion, wherein the horizontal portion does not extend to rearward edges of the side portions.

16. The collar of claim 15 wherein the upper peripheral flange includes a gap therethrough.

17. A container assembly including the collar of claim 15, the container assembly comprising:

a container body having a side wall extending upward from a base to define a mouth;

wheels mounted to a lower rear portion of the container body;

a handle spaced rearwardly of the container body;

a lid pivotably secured to the handle and pivotable between an open position and a closed position over the mouth of the container body;

a latch configured to connect a front portion of the lid to a front portion of the container body; and the collar secured to an upper edge of the side wall of the container body.

18. The container assembly of claim 17 wherein the container body includes a lip extending outward and downward at an upper edge of the side wall and wherein the collar is secured to the lip of the container body.

19. The container assembly of claim 17 wherein an interior of the container body is approximately 95 gallons.

20. The container assembly of claim 18 wherein the horizontal portion of the collar is secured to an upper surface of the lip.

21. The container assembly of claim 20 wherein the lid includes a cover portion received within the upper peripheral flange when the lid is closed.

22. The container assembly of claim 21 wherein the lid includes a lower rim received within the container body.

23. The container assembly of claim 20 wherein the collar is secured to the lip by fasteners extending through the horizontal portion of the collar and the lip.

* * * * *